United States Patent [19]

Berger

[11] Patent Number: 4,635,700

[45] Date of Patent: Jan. 13, 1987

[54] SELF-ADJUSTING CANVAS TENSIONING FRAME

[76] Inventor: Gustav A. Berger, 115 W. 73rd St., New York, N.Y. 10023

[21] Appl. No.: 571,350

[22] Filed: Jan. 16, 1984

[51] Int. Cl.[4] ..... D06C 3/28; E06B 3/26

[52] U.S. Cl. ..... 160/374.1

[58] Field of Search ..... 160/374, 374.1, 378, 160/376, 402, 377, 373, 379; 38/102.91, 102.9, 102.5, 102.4

[56] References Cited

U.S. PATENT DOCUMENTS

| | | | |
|---|---|---|---|
| 142,232 | 11/1873 | Holly | 160/378 Y |
| 1,857,425 | 5/1932 | Brewer | 160/376 |
| 2,197,489 | 4/1940 | Trulock | 160/378 |
| 2,456,225 | 12/1948 | Thomas | 45/130 |
| 3,133,375 | 5/1964 | Myren | 45/130 |
| 3,529,653 | 9/1970 | Fey, Jr. | 160/374.8 |
| 3,914,887 | 10/1975 | Newman | 38/102.8 |
| 4,006,771 | 2/1977 | Spurkel | 160/378 |
| 4,114,945 | 9/1978 | Lutz | 308/3 R |
| 4,263,361 | 4/1981 | Hodes et al. | 308/DIG. 7 |
| 4,301,853 | 11/1981 | Vidal | 160/374.1 |

*Primary Examiner*—J. Franklin Foss
*Assistant Examiner*—Cherney S. Lieberman
*Attorney, Agent, or Firm*—Reese Taylor

[57] ABSTRACT

A tensioning frame for stretching and keeping stretched upon it a canvas sheet in a plane configuration and with uniform tension, some or all of the outer edge of the canvas sheet being capable of sliding motion over the outer edge of the rigid structure covered by it and attached to it by means of springs. The force of each spring may be adjusted in situ to the tension desired in the canvas sheet. The tension and plane configuration of the canvas sheet is thus maintained in spite of the effects of temperature, humidity, or weight. Sliding of the contacting surfaces is facilitated by layers of a low-friction substance.

9 Claims, 9 Drawing Figures

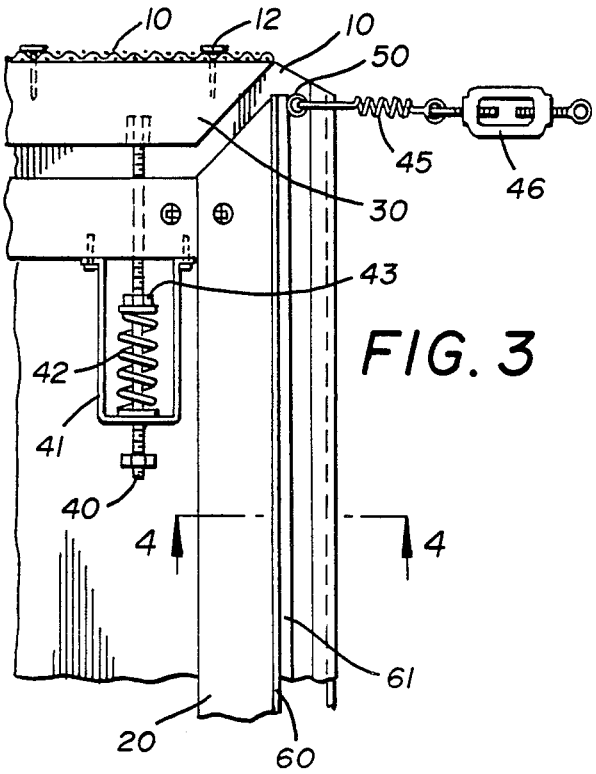
FIG. 3
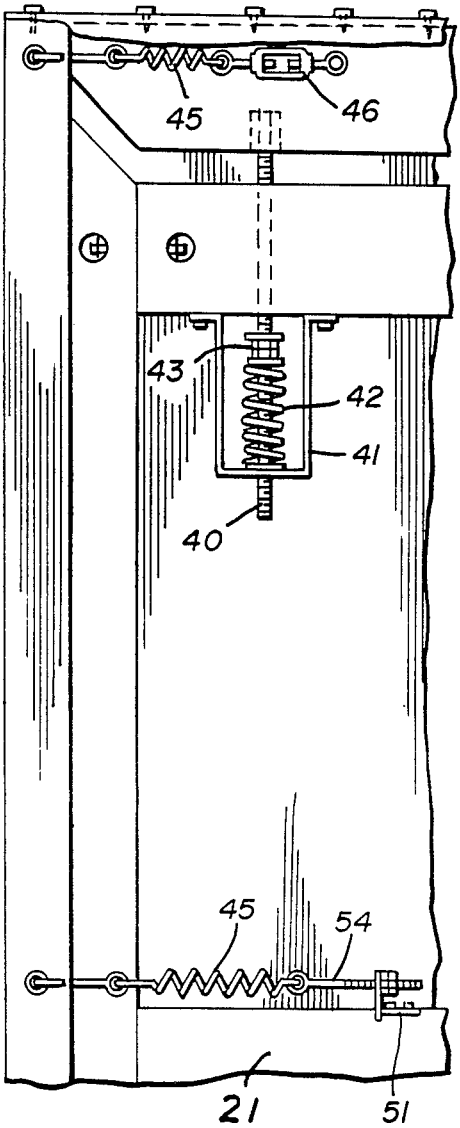
FIG. 6
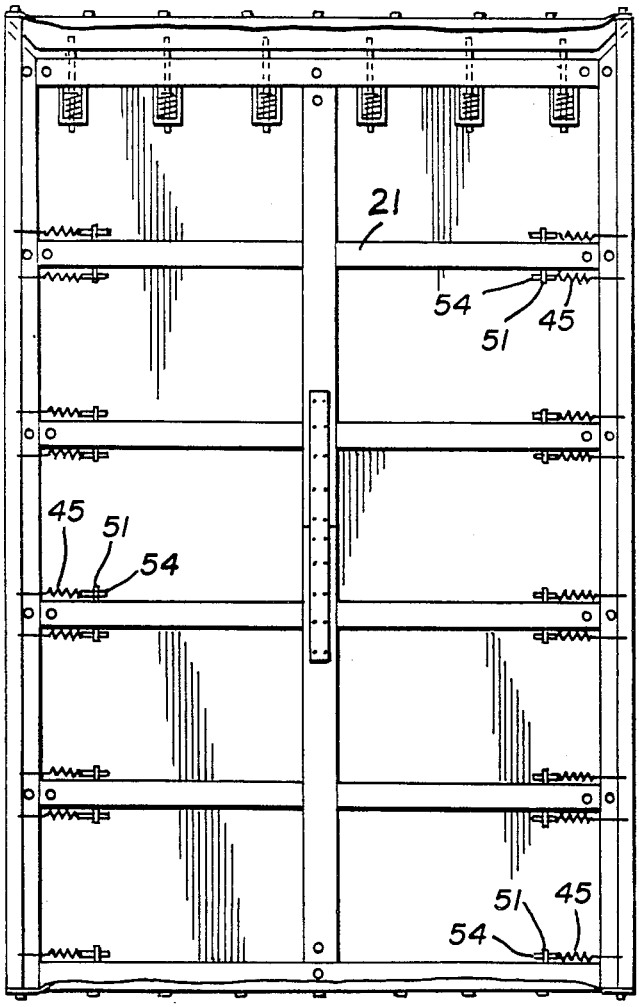
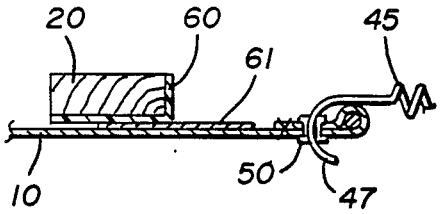
FIG. 4
FIG. 5

SELF-ADJUSTING CANVAS TENSIONING FRAME

BACKGROUND OF THE INVENTION

Historically and conventionally artist's canvas or pictures painted on canvas have been stretched over wooden frames by firmly attaching the edges of the canvas sheet to the frame, upon which it is being stretched, by means of tacks, staples, nails, or clamps spaced at short distances from each other. Slackness, bulges, wrinkles, and deformations in the canvas that are normally caused by changes due to gravity, temperature, humidity or deformations of the frame, to which the canvas sheet is attached, could be corrected by repeating the tensioning operation which meant separating the canvas sheet from the frame and reattaching it in a laborious and time consuming operation requiring considerable skill and practice. Customary methods of achieving minor corrections in tensioning of canvas stretched over a frame have involved changes in construction of the corner pieces to allow varying their size or wedging apart the corner joint of the frame, generally called "keying out". Such localized adjustments necessarily lead to higher stresses in the corner regions of the canvas with possible distortions and damage to the painting.

Illustrative of the prior art for tensioning canvas over frames are: U.S. Pat. No. 142,232 by Holly, where an outer frame is held by dowels and springs against an inner frame, the effect being "keying out" of the canvas sheet with most of the tensioning forces at the spreadable corners and no adjustment of the spring forces in situ provided; U.S. Pat. No. 2,456,225 by Thomas, where helical springs exert pull to hold tack-like projections of a ferrule along the frame to attach the canvas, the tensioning of the canvas to be done by conventional "keying out"; U.S. Pat. No. 3,133,375 by Myren, with a construction of the mitered corner joints of the frame that permits "keying out" at the corners by inserting a wedge to a needed depth, resulting in tensioning at the corners of the canvas sheet; U.S. Pat. No. 3,529,653 by Fey, where the frame sides have L-shaped cross sections, the canvas being clamped rigidly around their flanges by means of channels fitting over them, the corner structures with toggle braces for stretching the assembly at the corners; U.S. Pat. No. 3,914,887 by Newman, where the edges of the canvas are held tightly in the channel-shaped inside of the frame sides, screw mechanism enabling the corner members to be adjusted in their distance from the sides of the frame and screw mechanisms to govern the tension at the corners, thus after mounting only allowing manipulation at the corners. Suffice it, the prior art does not permit spontaneous adjustment of the tension in the canvas along the circumference of the frame, nor spontaneous maintenance of tension over the sheet, nor setting of the tension by springs to a value desired, that is automatically maintained in the tension of the mounted canvas, nor does it permit later adjustment of springs in situ to another desired tension value.

SUMMARY OF THE INVENTION

The present invention relates to a canvas tensioning frame defined by members forming a rectangle somewhat smaller in size than the canvas sheet to be tensioned by the frame, their ends mitered or constructed to insure contact with each other at right angles or angles required by the shape of the canvas. Edges of the canvas sheet may be attached to the outward facing edge of the top and bottom members by conventional means, however, one or both of these members may be movable in the plane of the tensioning frame and connected to the rigid inner structure of the tensioning frame by spring mechanisms or spring-and-bolt arrangements.

An important feature of the present invention is the capability of the spring mechanisms or spring-and-bolt arrangements to permit setting the force exerted by each spring at a magnitude corresponding to the tension desired in the canvas stretched upon the tensioning frame. Additional outward facing edges of frame members or alternately all outward facing edges of the rigid structure are in sliding contact with edges of the canvas sheet. All surfaces in sliding contact with each other may bear a coating or layer of a low friction substance which may consist of polytetrafluroethylene.

The border of the sliding canvas edges bears grommets at intervals, to which grommets spring mechanisms may be attached as connection to the rigid inside part of the tensioning frame and capable of having the force exerted by the springs adjusted to produce desired uniform tension in the canvas sheet.

In place of the grommets a slender rigid bar or bar-shaped segments may be affixed to the border of the canvas edge, so that the force exerted may be distributed along the edge more uniformly than by use of grommets. Edge areas of the canvas sheet may be made to form a sleeve in which such bars or bar segments are held, but with some freedom to slide with respect to the sleeve, to give optimal distribution of the force exerted by the springs.

Shapes of tensioning frames with outlines deviating from rectangular may be constructed. The rigid inside part of the tensioning frame may be a hollow rectangle or other outline or a hollow rectangle with cross-bracing or having a rigid flat member fill the inside of the frame or such a rigid flat member connected to the cross-bracing and in gently supporting contact with the canvas sheet, in all cases a rigid structure strong enough to hold the spring mechanisms connecting it to the structures at the edges of the canvas sheet under constant tension or compression.

For the purpose of illustrating the invention, there are shown in the drawings forms of construction which are presently preferred; however, it is to be understood that the invention is not limited to the modalities, arrangements and instrumentalities shown.

In the drawing:

FIG. 3 is an enlarged fragmentary view of an upper corner in FIG. 1.

FIG. 4 is an enlarged sectional view along the line 4—4 in FIG. 3.

FIG. 5 is a rear elevational view showing yet another embodiment of the invention.

FIG. 6 is an enlarged fragmentary view of an upper corner of FIG. 5.

DESCRIPTION OF THE INVENTION

Figure 1:
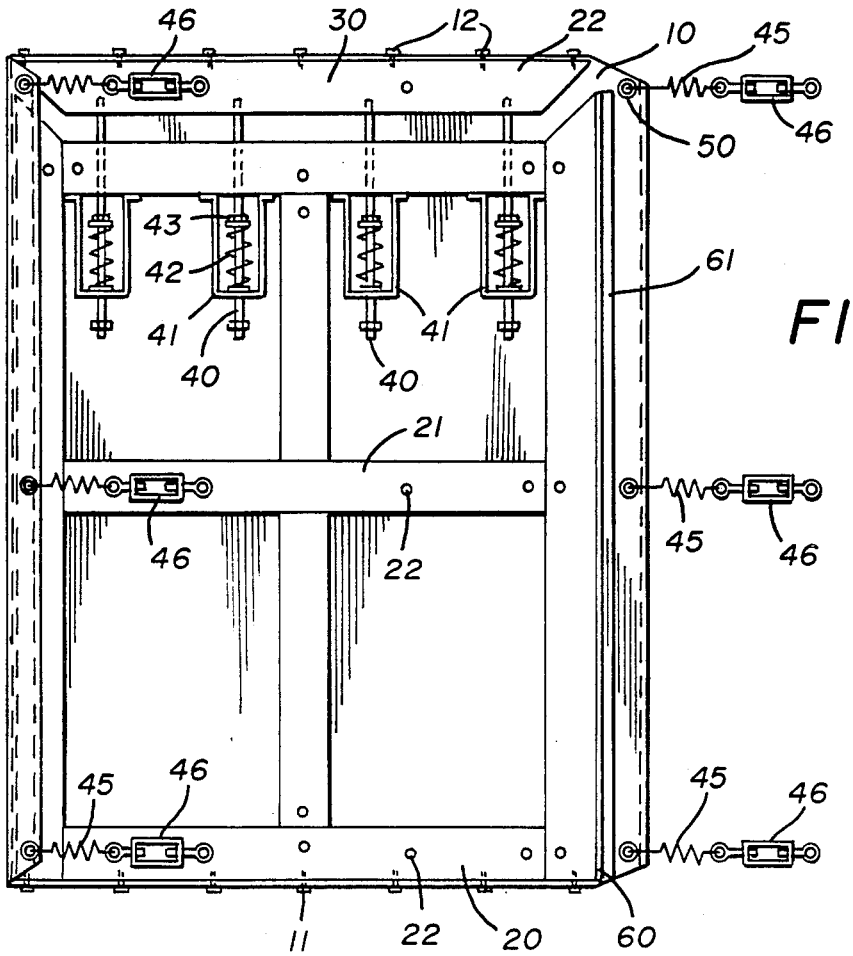
FIG. 1 is a rear elevational view of a self-adjusting canvas tensioning frame in accordance with the present invention, with a canvas sheet partially mounted thereon.

Referring to the drawing, wherein like numerals indicate like elements of the invention, there is shown in FIG. 1 an embodiment of the self-adjusting canvas tensioning frame according to this invention with a canvas sheet 10 mounted, except its right-hand side not yet attached to the rigid inner structure 20. The approximately rectangular structure 20 is strenghtened by cross-bracing 21. The canvas sheet 10 is attached to the bottom edge of structure 20 by tacks 11 and to a separate rigid outer structure 30 by tacks 12, structure 30 being parallel to the edge of the inner structure 20. The structure 30 is held at a small distance from the facing edge of the inner structure 20 by threaded bolts 40 through the forces exerted against brackets 41 by springs 42. The forces thus exerted may be adjusted to the value desired by turning the hexagonal nuts 43 on bolts 40 to compress the springs 42. At intervals along the left and right edge regions of the canvas sheet 10 are firmly implanted grommets 50; in the holes provided by grommets 50 are received the hooked ends 47 of springs 45, the other end of springs 45 being attached firmly to turnbuckles 46, which are connected to structure 20, its cross-bracing 21, or to structure 30, by device 22, depending on the position of the grommets 50 along the edge region of the canvas sheet 10.

Edges of the inner structure 20 are covered with a polymer layer 60 presenting a low-friction surface. A similar polymer layer 61 is borne by the edge region of the canvas sheet 10. When the canvas sheet 10 is mounted on structure 20 by folding it around the outer edge of structure 20,, the facing surfaces of 60 and 61 are in intimate yet sliding contact, permitting some movement with respect to each other as required to distribute forces uniformly in the canvas sheet 10, because of the self-lubricating nature of the polymer used, such as polytetrafluoroethylene.

FIG. 3 is an enlarged view of the corner area in FIG. 1 and FIG. 4 is a further enlarged sectional view along line 4—4 of FIG. 3.

Figure 2:
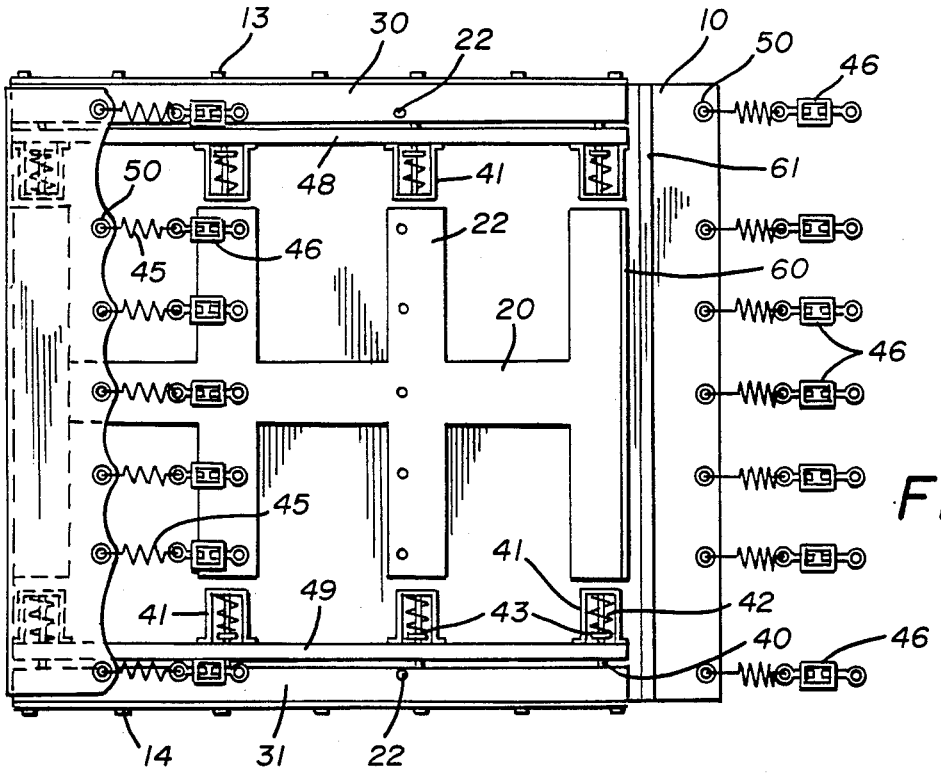
FIG. 2 is a rear elevational view, similar to FIG. 1, showing another embodiment of the invention.

In FIG. 2 there is shown a rear elevational view of another embodiment of a self-adjusting canvas tensioning frame according to this invention having an inner rigid structure 20 in the form of a horizontal center with vertical extensions, an upper outer rigid bar-like structure 30 and a lower such structure 31. The upper edge of the canvas sheet 10 is attached to structure 30 by staples 13 and the lower edge to structure 31 by staples 14. Structures 30 and 31 are held separated from bars 48 and 49 by bolts 40 held under the tension of springs 42, the tension being adjustable by turning nuts 43 and being exerted against the brackets 41 on bars 48 and 49, the brackets 41 pressing against the rigid inner structure 20. The side edges of canvas sheet 10 bear grommets 50, which are connected to the inner structure 20 by springs 45 and their turnbuckles 46, the turnbuckles 46 serving to adjust the tensions in springs 45 to their desired magnitudes. A layer 60 of a suitable low-friction substance such as polytetrafluoroethylene covers the outer edge of structure 20 as shown and another layer 61 of the same substance is borne by the edge region of canvas sheet 10, so that the layers 60 and 61 are in sliding contact with each other under the tension-compression provided by the springs 45.

It is readily seen how the tension in the springs arranged along the outline of the rigid inner structure 20 serves to keep the canvas sheet 10 flat and how any forces in it due to weight, contraction, impact from the outside, as well as forces due to the springs of the tensioning frame are distributed uniformly throughout the canvas sheet 10, because its edge regions are permitted movement by the sliding contact of layers 60 and 61 and by the movement of rigid outer structures 30 and 31 under control of springs 42.

In FIG. 5 is shown a rear elevational view of another embodiment of the invention having numerous cross-braces 21 assuring rigidity of the inner rigid structure 20 for tensioning larger areas of canvas. As added support a rigid sheet nearly the size of the canvas area may be inserted between the tensioning frame and the canvas sheet 10. The springs 45 holding grommets 50 on the side edge regions of canvas sheet 10 are attached to threaded bolts 54, which may be turned in brackets 51 on cross-braces 21 to produce the desired tension in springs 45.

FIG. 6 shows an enlarged portion of FIG. 5, illustrating the construction of the attachment of spring 45 to the cross-bracing 21 by the bolt 54 and the bracket 51 and also the arrangement of the canvas sheet 10 over the corner of the canvas tensioning frame.

Figure 7:
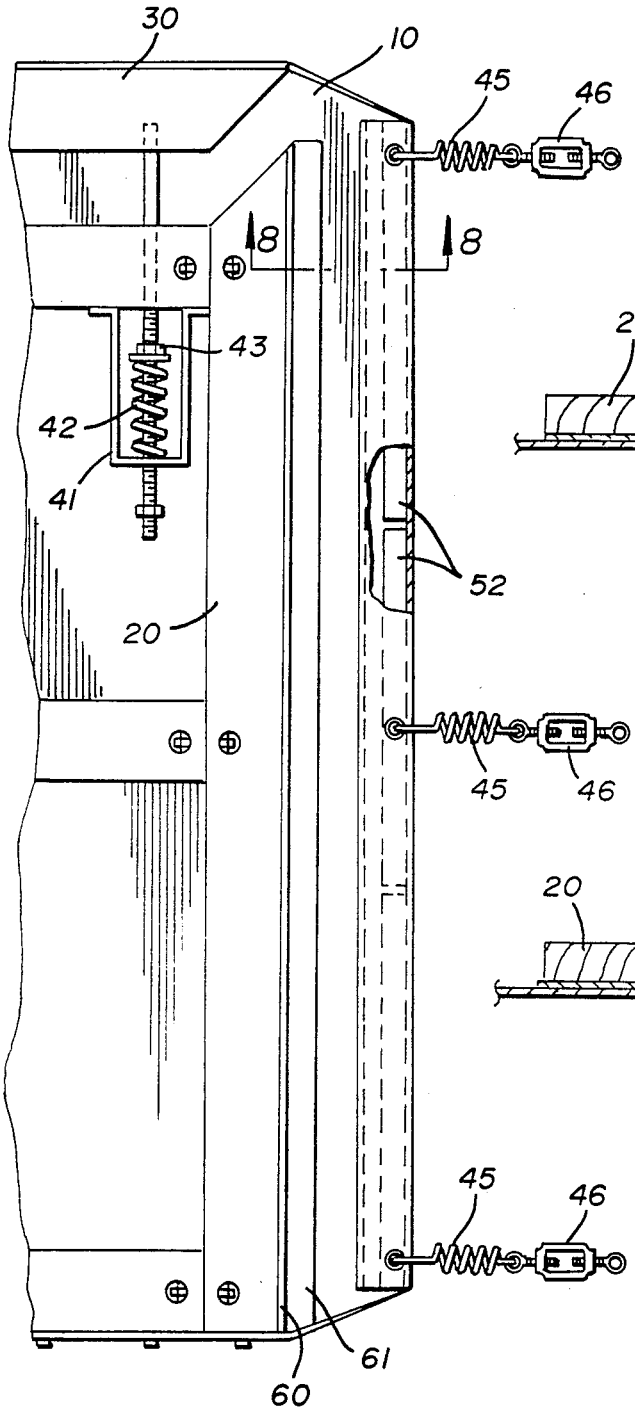
FIG. 7 is a fragmentary rear elevational view of another embodiment of the invention showing bars inserted in sleeves formed by the edge regions of the canvas sheet.

FIG. 7 shows the rear elevational view of one side of a canvas tensioning frame in another embodiment of the invention, the side of canvas sheet 10 not attached to the tensioning frame to illustrate this embodiment of the invention, in which the edge region of canvas sheet 10 forms a sleeve containing rigid bars 52 serving to distribute the forces exerted by springs 45 uniformly along the side of canvas sheet 10.

Figure 8:
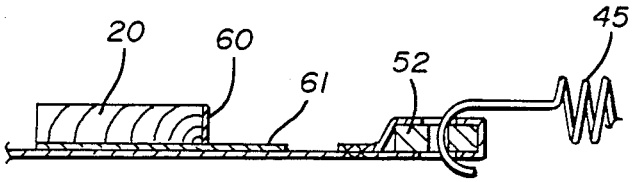
FIG. 8 is an enlarged sectional view along line 8—8 of FIG. 7.

FIG. 8 is an enlarged sectional view along line 8—8 of FIG. 7, showing the edge region of canvas sheet 10 with the sleeve formation and the rigid bars in it, also the low-friction layers 60 and 61 on structure 20 and on the edge region of the canvas sheet.

Figure 9:
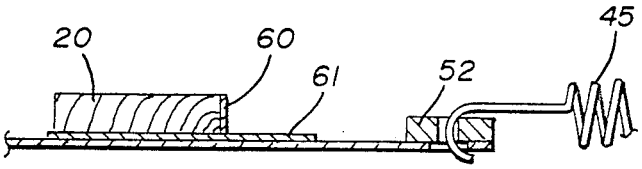
FIG. 9 is a sectional view, similar to FIG. 8, showing an embodiment, wherein bars are attached to edge regions of the canvas sheet.

FIG. 9 is an enlarged sectional view similar to FIG. 8, showing an embodiment of the invention having bars 52 attached by adhesive, riveting, or similar means, to the edge region of the canvas sheet.

I claim:

1. A canvas tensioning frame structure for maintaining a constant tension and a plane configuration in a canvas sheet stretched upon said frame structure comprising:

(A) a rigid inner structure;

(B) first and second spring means attached to said rigid inner structure with said spring means being constructed so as to permit the magnitude of the tension in each spring means to be set at values desired;

(C) at least one outer structure holding at least a first edge region of the canvas sheet;

(D) said first spring means interconnecting said outer structures and said rigid inner structure and said second spring means interconnecting the canvas and said inner structure and said outer structure;

(E) some of the remaining edge regions of the canvas sheet being slidably arranged over at least a portion of opposed outward facing edges of said rigid inner structure; and a layer of suitable low-friction substance on at least one of said outward facing edges of said inner structure and the remaining edge regions of the canvas sheet.

2. A canvas tensioning frame structure according to claim 1, wherein said outer structure includes at least one rigid body nearly the length of an edge of the canvas sheet and attached to the edge region of the canvas sheet.

3. A canvas tensioning frame structure according to claim 2, in which the canvas is substantially rectangular in planar configuration and two oppositely situated edge regions of the canvas sheet are slidably arranged over outward facing edges of the rigid inner structure and the remaining edge regions are fixed to said rigid inner structure and said rigid body.

4. A canvas tensioning frame structure according to claim 1, wherein the geometric outline of the frame corresponds to the shape of the canvas sheet to be tensioned.

5. A canvas tensioning frame structure according to claim 1, in which grommets are disposed at intervals about said remaining edge regions of the canvas sheet; said second spring means engaging said grommets.

6. A canvas tensioning frame structure according to claim 1, in which narrow rigid bars are affixed at intervals along said remaining edge regions of the canvas sheet; said second spring means engaging said narrow rigid bars.

7. A canvas tensioning frame structure according to claim 1, in which narrow rigid bars are held slidingly in sleeves formed by said remaining edge regions of the canvas sheet; said second spring means engaging said narrow rigid bars.

8. A canvas tensioning frame structure according to claim 1, in which the layer of suitable low-friction substance is a polymeric material.

9. A canvas tensioning frame structure according to claim 8, in which the polymeric material is polytetrafluoroethylene.

* * * * *